United States Patent [19]

Henderson

[11] Patent Number: 4,526,520

[45] Date of Patent: Jul. 2, 1985

[54] PUMP

[76] Inventor: James K. Henderson, 11 Parkend Ave., Brampton, Ontario, Canada, L6Y 1B4

[21] Appl. No.: 583,597

[22] Filed: Feb. 27, 1984

Related U.S. Application Data

[63] Continuation-in-part of Ser. No. 466,373, Feb. 15, 1983, abandoned.

[51] Int. Cl.[3] ..... F01B 9/00; F04B 17/00; F04B 35/00

[52] U.S. Cl. ..... 417/559; 417/900; 92/140

[58] Field of Search ..... 417/403, 559, 900, 454; 92/128, 140

[56] References Cited

U.S. PATENT DOCUMENTS

| | | | |
|---|---|---|---|
| 550,329 | 11/1895 | Rennerfelt | 417/536 |
| 551,157 | 12/1895 | De Clercq | 92/140 |
| 806,140 | 12/1905 | Helm | 74/105 |
| 1,039,154 | 12/1912 | Lucas | 92/168 |
| 1,315,089 | 9/1919 | Camfield | 92/140 |
| 1,597,156 | 8/1926 | Holdaway et al. | 92/168 |
| 2,169,703 | 8/1939 | Mason | 417/900 |
| 2,292,375 | 8/1942 | Hansen | 417/203 |
| 2,678,609 | 5/1954 | Ashton | 417/900 |
| 2,836,122 | 5/1958 | Johnson | 417/900 |
| 2,957,430 | 10/1960 | Naef | 417/403 |
| 2,985,111 | 5/1961 | Henderson | 97/140 |
| 2,998,781 | 9/1961 | Triebel | 417/900 |
| 3,216,365 | 11/1965 | Dottinger et al. | 92/168 |
| 3,330,217 | 7/1967 | Baur et al. | 417/555 |
| 3,356,036 | 12/1967 | Repp | 92/168 |
| 3,559,539 | 2/1971 | Nagy | 92/128 |
| 3,684,406 | 8/1972 | Edwards | 417/454 |
| 3,849,033 | 11/1974 | Schall | 417/454 |
| 3,876,327 | 4/1975 | Lobanoff | 417/423 R |
| 3,906,845 | 9/1975 | Wegmann | 92/168 |
| 3,967,542 | 7/1976 | Hall | 92/128 |
| 4,431,384 | 2/1984 | Walson | 417/403 |

FOREIGN PATENT DOCUMENTS

| | | | |
|---|---|---|---|
| 2068475 | 8/1981 | United Kingdom | 417/403 |

*Primary Examiner*—William L. Freeh

[57] ABSTRACT

A positive displacement pump has a cylinder closed at one end and a plunger projecting from the opposite end reciprocable therein. Rings and packing are inserted at the opposite end to guide the plunger and are designed to provide that the plunger has a material clearance from the cylinder walls. To use a different sized plunger the rings and packing are designed for easy removal at the end of the cylinder and for replacement by rings and plunger corresponding to the new plunger section. A convenient manual linkage is provided for manual operation of the pump with the cylinder upright. A convenient horizontal frame is provided for the pump with a drive means for the pump used with the cylinder in a horizontal position.

4 Claims, 3 Drawing Figures

PUMP

This application is a continuation-in-part of application Ser. No. 466,373 filed Feb. 15, 1983, now abandoned.

This invention relates to a single acting plunger type positive displacement pump.

The pump is designed for pumping materials of various consistency from water on the one hand to relatively thick slurries such as liquid cement or thick liquid cement sanded slurries on the other hand.

It is an object of the invention, in one aspect, to provide a single acting type positive displacement pump which is much less likely to clog or sieze than prior models and is much easier to clean.

It is an object of the invention, in another aspect, to provide a single acting type positive displacement pump which may be simply and easily converted to alter its volume flow and pressure performance characteristics.

It is an object of the invention, in another aspect, to provide a single acting type positive displacement pump in combination with a manual operating linkage, the latter being designed to allow operation of the pump by two men.

It is an object of the invention, to provide a pump and operating linkage, as described in the previous paragraph where the pump is designed for easy conversion of plunger diameter to alter the volume flow and pressure qualities of the pump whereby a wide range of operating modes are available for operation as a two man manual pump.

It is an object of the invention to produce a hand pump best suited for sealing off inflow water in such areas or applications as: wet concrete lined mine shafts, leaking roof bolts in mines, subway stations, tunnels, sewer tunnels, swimming pools, concrete floors in warehouses, basements and the like, and in the arresting of the settlement of concrete floors in warehouses, basements and the like.

Certain advantages of the invention are discussed following the description of the specific embodiment and others are interspersed with such description.

Figure 1:
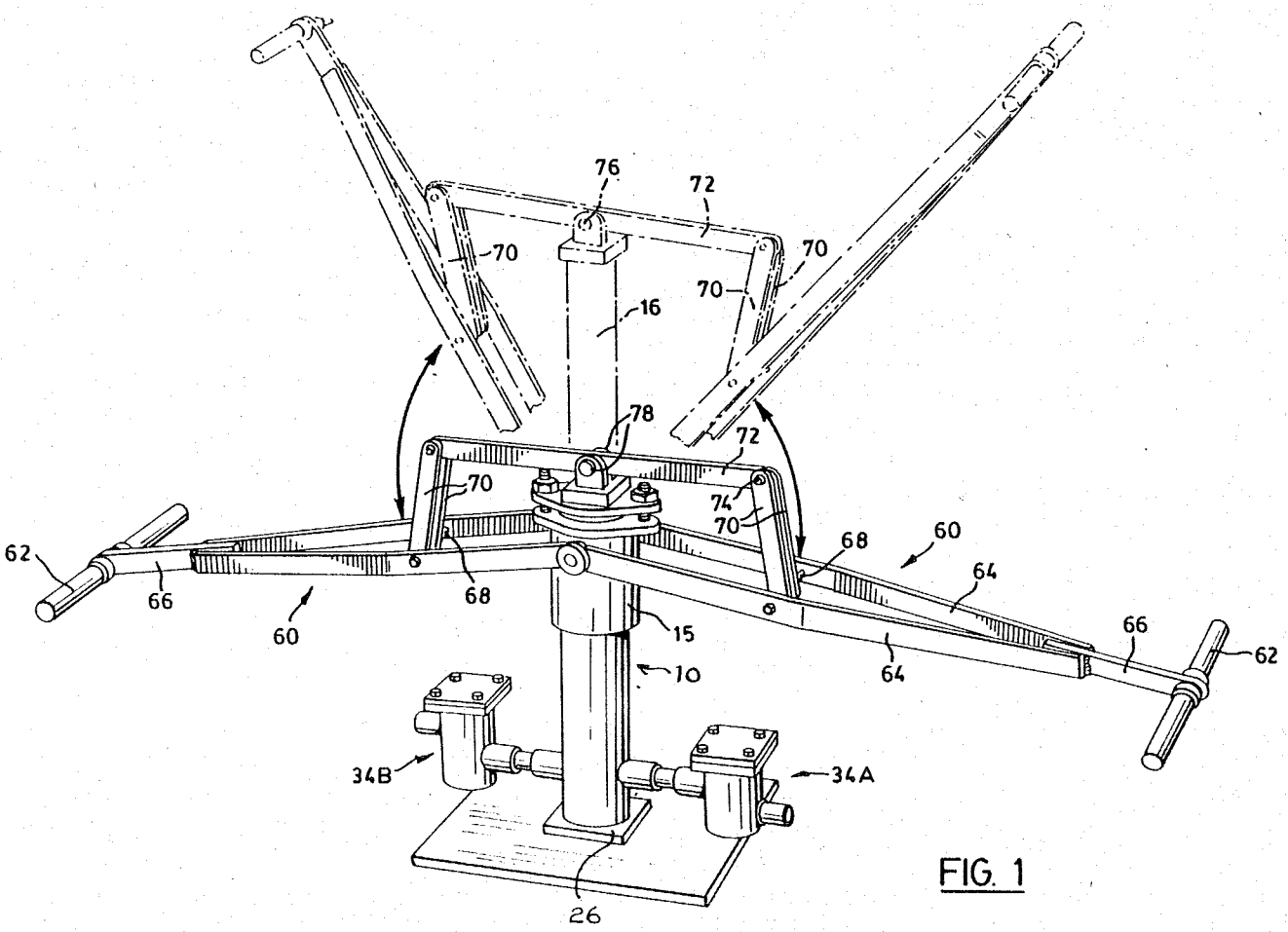
Figure 2:
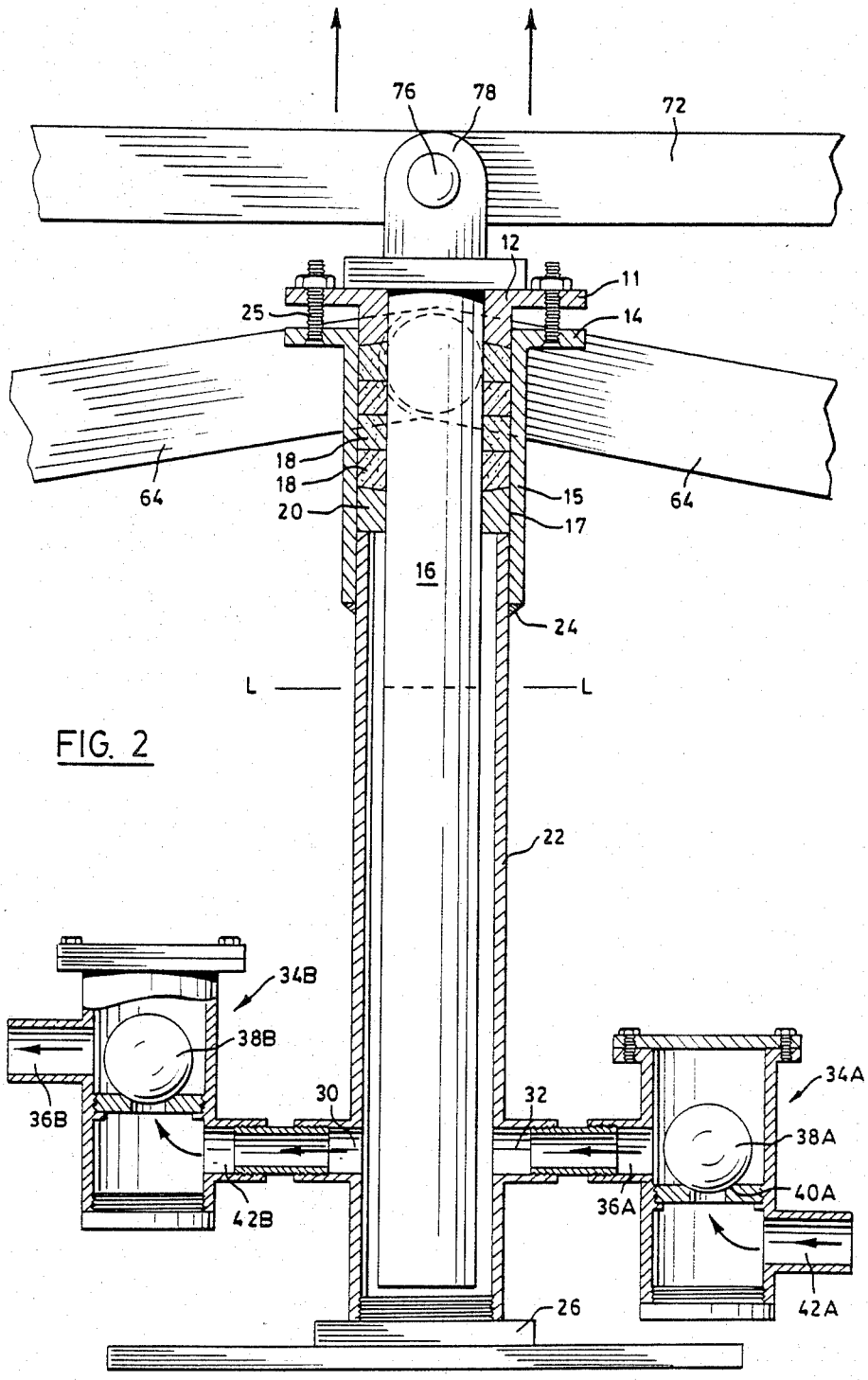
Figure 3:
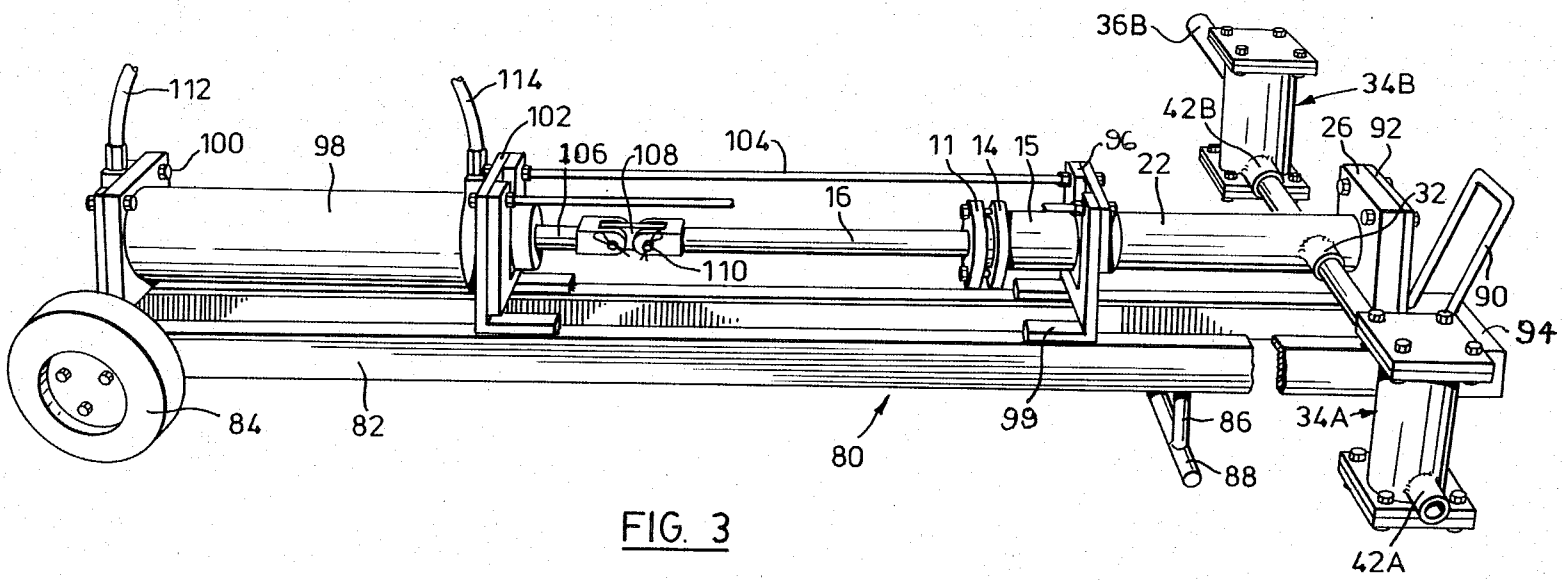

In drawings which illustrate a preferred embodiment of the invention:

FIG. 1 is a perspective view of a pump including the two man manual operating linkage all in accord with the invention; and FIG. 2 is a vertical cross section taken along a vertical plane through the pumping cylinder and values; and FIG. 3 is a perspective view of the pump mounted horizontally on a frame for operation by a drive means.

In accord with the preferred embodiment a cylinder 10 is provided with a ring 12 which may be bolted by its flanges 11 to an upper flange 14 on the upper body 15 of the cylinder. The ring 12, inward of flange 14, is shaped to form a sleeve liner for the cylinder and is provided with a central aperture to make a sliding fit with the plunger 16. The lower surface of ring 12 slopes downward in a radially outward direction to bias inwardly toward the plunger the packing on which it bears. Below the ring 12 packing 18 fills the space between the inner surface 17 of the upper cylinder body 15 and the outer surface of the plunger 16. In other words the packing is shaped to make a close sliding fit with the surface of the plunger 16 and thus to prevent the upward passage of liquid or slurry from the pumping chamber. Below the packing is provided a second rin 20 of outer diameter to make a close fit with surface 17 and of an internal diameter selected to make a sliding fit with the plunger. This lower ring 20 at its upper surface is chamferred upwardly in a radially outward direction to bias the packing 18 inwardly against the plunger. Means are provided for preventing downward movement of ring 20 which may take any desired form. However, in the preferred embodiment shown such stop is provided by forming the plunger cylinder of an outer upper cylinder 15 and an inner lower cylinder 22. Such cylinders are overlapped and sealed at their overlap by any desired means such as welding 24. The step formed by the upper edge of cylinder 22 forms the stop limiting downward movement of ring 20. Thus starting with an empty cylinder 15, 22 the rings and backing are then provided through the then open top of the cylinder. First ring 20 is inserted to its contact with the upper edge of cylinder 22, then packing 18 is added. Finally ring 12 is inserted in the cylinder over the packing and bolts 25 inserted and tightened to compress the packing between the two rings.

At the lower end of the cylinder 22 a screw cap 26 threadedly attaches to the main body of the cylinder 22 wall.

The pumping capacity and pressure of the pump may be altered by replacing the plunger 16 shown by one of a different diameter. (A smaller diameter plunger will provide lower flow and higher operating pressure and a larger diameter plunger will have the opposite effect). Thus to convert the pump to one with a different diameter plunger then, in addition to replacing the plunger, the upper ring 12 packing 18 and lower ring 20 are removed after removing bolts 25 and these members are replaced with new upper and lower rings and packing having the same outer diameter but the different inner diameter selected to make the sliding fit with the new diameter pistons. The bolts 25 are then replaced.

It will be noted that the diameter of the cylinder 22 will be chosen to be wide enough, having regard to the range of plungers to be used, that there is a substantial clearance between the plunger 16 and the inner wall of cylinder 22. This substantial spacing allows easy plunger reciprocating movement even with thick slurries, while upward escape of the contents of the pump chamber is substantially prevented by the close sliding fit between the plunger and its coordinated rings and packing. It will be noted that the cylinder need not be of round cross section. Nor need the plunger be of round cross section although its section will be the same as the apertures in the lower ring, upper ring and packing.

For operation as a pump ports 30 and 32 are provided on opposite sides of the pumping chamber. Although these ports may be used interchangeably, port 32 ishere used as the intake and is connected to the discharge port 36A of ball valve 34A having ball 38A and seat 40A. The intake port 42A of ball valve 34A is connected to the supply or source (not shown) of the liquid or slurry being handled by the pump. The pump discharge port is connected to a ball valve 34B. The ball valve 34B at the discharge port is identical in design to valve 34A at the intake and similar parts in the valve 34B have the same number with a affix "B". The intake 42B of the ball valve 34B is connected to the discharge port 30 of the cylinder 15 while the discharge 36B will be connected to a conduit (not shown) associated with the pump, to conduct the liquid, slurry or other material being pumped to its desired destination.

In the operation of the pump, each upstoke of the plunger 16 creates suction in the pumping chamber and the liquid or slurry is drawn in through valve 34A while valve 34B is blocked due to the suction. In FIG. 2 level L-L is indicated as the upper limit for the excursion of the plunger which is shown in its lower position. On each down stroke of the plunger the pressure created in the pumping chamber closes intake valve 34A and drives the liquid or slurry out through valve 34B. The operation of the pump is certain and simple, and very efficient, particularly for slurries, since the use of a plunger instead of a piston together with the substantial clearance or spacing between the plunger 16 and the wall of cylinder 22 allows the pump to operate with very thick slurries which do not tend to clog the pump due to the substantial clearance provided. Moreover the precise fitting which would be required of a piston is not required, the sliding fit at the lower ring and the packing thereabove preventing leakage of such slurries without the precision of fit and complexity of design required if a piston were used.

Cleaning the pump just described has been found to be easy and no stripping of the pump parts is required even after pumping such a slurry as liquid cement grout. It is merely necessary to continue the pumping operation while feeding clean water through the pump intake. The pump is clean when the discharge is clear clean water.

It is now desired to describe the operating linkage whereby the pump, as described may be manually operated by two men.

Pivot pins 54 are mounted on the outside of cylinder 15 in diametrically opposed locations. Pivotally mounted on pins 54 are arms 60 extending on each side of the cylinder and the pivoting about pins 54 is about a substantially horizontal axis. Each arm 60 is designed for strength and comprises a pair of rectangular strip or rod members 64 with their large dimension perpendicular to the pivot axis connected to the opposed pins 54 and extending to join at the outer ends by welding or other convenient attachment to a central outwardly extending strip 66 which mounts adjacent its outer end a transversely extending handle 62. The handle 62 is preferably mounted to be rotatable about its own longitudinal axis relative to strips 66 for ease in use.

Intermediate the ends of each arm 60 and preferably about one third of its length measured from the pivot point 54, there is provided a rod 68 extending between strips 64. On rod 68 are pivotally mounted a pair of links 70 (which act as a single link) and are designed to extend upwardly from the strip 64. Such pairs of links 70 are provided with registering pairs of holes adjacent their upper ends and between them is placed the end of a plunger link 72 for pivotal attachment by pivot pin 74. The plunger link 72 is pivotally connected to by a pivot pin 76 between ears 78 attached to the upper end of plunger 16. The plunger link 72 is a rigid member extending on each side of the plunger to a locus above the corresponding rod 68 and varying from just inward to just outward of the lower ends of the links 70. The plunger link 72 is mounted on its ears in such a way as to be free to tilt relative to the plunger 16 for reasons to be described.

Pivot axes represented by pins 54, rods 68, pins 74 and pin 76 are substantially parallel and approximately horizontal.

In operation with the ball valves 34A and 34B connected to the cylinder, the intake of the ball valve 34A connected to the source of liquid or slurry and the discharge of ball valve 34B connected to the pumping destination for such material, a pair of operators grasp the handles 62 and together raise and lower arms 64 to operate the linkage, hence the plunger 16 and the pump. Although it is intended that the two operators shall work approximately in synchronism, it is noted that this is not essential and that the linkage is particularly designed to produce pure up and down operation of the plunger without undue strain on the plunger or its mounting even if one operator has a longer upward and downward stroke or is ahead of the other in the cycle. FIG. 1 is in fact specifically drawn to show the operation with one arm describing a larger amplitude than the other.

When the pump of the invention is used in grouting operations where thick slurries are pumped, it is found, that the injection pressures and volumes of the grout mixtures pumped are controlled by the versatile action of the two pump arms 60. With a man on each handle, the upward stroke of the pump handles raises the pump plunger to create a vacuum. Such vacuum draws the liquid slurries from a mixing tank (not shown) connected to the valve 34A up and through the valve 34A to fill the plunger chamber. The downward stroke of the pump arms 60 forces the plunger down to simultaneously seat the valve 34A while forcing the trapped slurries out through valve 34B. Such pumping procedures are continued until the pressure of the outflow rises to the desired injection pressure. Injection pressures can be increased by the provision of extensions on the arms 60 are the substitution of larger arms. Injection pressures exceeding 300 P.S.I. have been attained in this way.

The hand pump thus designed can be used in areas difficult of access which would normally require an air operated pump with long air lines and a compressor.

The manual pump of the invention can be easily controlled with the pumping arms to produce accurate pressures. The injection pressures are produced on the downward stroke of the arms and can be controlled by hand at high injection pressures.

Although the connector links 70 are shown as extending upwardly from the operating arms to the plunger link it will be appreciated that the pump will operate if this direction is reversed. Thus the arms 64 may be pivotally mounted on upward extensions from the piston cylinder to be higher than the plunger link so that the direction of connector links 70 is reversed. It will however, be noted that the linkage will be such that the disposition of the links 70 retains a vertical component throughout their locus of movement or, in other words, the linkage should not be designed to allow links 70 to pass through a horizontal attitude over their locus of movement.

With reference again to the embodiment shown, it is noted that the arms 60 are pivotted centrally relative to the longitudinal plunger axis. It is within the scope of the invention to provide each arm 60 with its own pivotal connection which pivotal connections are preferably symmetrically disposed on opposite sides of the longitudinal axis. However, the latter arrangement has proved much less efficient (in the sense of pumping pressure and volume output) than the central common pivotal connection shown.

It is important to the practical use of the invention to note that shorter or longer arms 60 may be provided (for use with the linkage shown) to provide varying power or stroke ratios. In general longer arms will give more power and smaller volume per stroke and vice versa.

Although specific arm and linkage shapes are shown and double arm members (64) or double link members (70) are shown, single members of mechanical linkage equivalent or of other physical section are within the scope of the invention as defined by the appended claims.

FIG. 3 shows the pump on a frame designed for operation by drive means. A longitudinally extending frame 80 comprises spaced longitudinally extending angle irons 82 connected rigidly in spaced relationship by members hereinafter described. The frame is designed to rest on a horizontal surface with the angle irons extending approximately horizontally and is supported at one end by wheels 84 and at the other end by legs 86 and bar 88. A handle 90 is provided for manually lifting the frame and is rigidly attached thereto, preferably by welding, to project therefrom as shown. It will be seen that by lifting the frame by handle 90 so that bar 88 clears the ground the frame and mounted pump and drive may easily be rolled on wheels 84 from one location to another.

Mounted on the frame adjacent the handle 90 is the pumping cylinder. The cylinder is the same construction as that shown in FIGS. 1 and 2 but has its axis horizontal and longitudinally extending relative to the frame and the manual operating linkage of FIG. 1 is omitted. Thus, at the handle end of the frame, the screw cap 26 of the cylinder is bolted to a plate 92 bridging the angle irons 82 and welded thereto at plate 94. The plate 94 also may form the support for the handle 90. Plate 96 is welded about cylinder extent 15 and also to angle irons 82 at feet 99. At the wheeled end of the frame a compressed air drive shown schematically as longitudinally extending cylinder 98 which is rigidly attached to cross plates 100 and 102 the ends. Cross plates 100 and 102 are each welded to both angle irons 82 and with plates 92 and 96 make with the angle irons a rigid frame. Four tie rods 104 join the plates 102 and 96 and nuts on each side of the plates support them and maintain their spacing. The piston rod 106 projects from cylinder 98 toward the near end of plunger 16. The adjacent ends of rod 96 and plunger 16 are provided with bifurcated ends, as shown, so that they may be connected together by link 108 which is joined to both bifurcated end by coupling pins 110.

The air cylinder 98 and piston rod 96 are shown schematically with air supply conduits 112 and 114 for each end of the cylinder. The showing is schematic since the drive means is only exemplary of any drive means which it is desired to use at the pump-remote end of the frame. In the embodiment shown the air supplies will alternatively provide air to opposite ends of the compressed air cylinder controlled by controls and valving, not shown, to reciprocally drive piston 96 and with it the plunger 16 to provide the pumping action in the pump.

Instead of a compressed air a hydraulic drive may be used or a rotary drive with a suitable well known linkage for converting the rotation into reciprocation of plunger 16.

With each alternative the drive means will be rigidly mounted on the frame to form with the pump a convenient low profile pumping unit. The low profile is very convenient provided by the low horizontal frame and the horizontal disposition of the pump axis thereon.

The pump is as described from page 2 line 22 to page 6 line 1 and shown in FIG. 2 and provides the inventive features and the advantages claimed therefor. Because valves 34A and 34B are designed to operate with the ball seated by gravity, these are in the embodiment of FIG. 3 disposed with their axis vertical. Thus the axis of the valves are parallel to the axis of the pump cylinder in FIG. 2 and perpendicular to such axis in FIG. 3. Although the valves shown (in FIG. 2) are convenient to employ it will be appreciated that ball valves are available which operate without requiring a definite orientation and these, although more expensive may equivalently be used.

The design of the pump in accord with the invention permits small quantities of slurry mixtures to be mixed at a time, thus eliminating pollution or clogged drains such as from the waste cement slurries at the end of a grouting operation. Using the inventive pump, a thick liquid cement slurry with sawdust as an additive, can be injected to seal off large honey-combed multiple cluster leaks in porous concrete areas with minimum waste.

I claim:

1. Positive displacement pump having upright cylinder with plunger reciprocable therein, to define a plunger chamber therebelow of variable height, inlet passage to the plunger chamber, a valve in said inlet passage allowing flow only toward said chamber, outlet passage from the plunger chamber, a valve in said outlet passage allowing flow only out of said chamber, said plunger projecting upwardly out of said chamber, manual means for reciprocating said plunger comprising:

a pair of arms each arm being pivotally connected to said plunger cylinder, arranged to project therefrom on opposite sides of said cylinder, a plunger link pivotally connected to said plunger adjacent the upper end and designed to extend transversely on each side thereof, a pair of connector links, each connector link being pivotally connected at one end to an arm and at the other end to the plunger link adjacent the corresponding end thereof, the pivotal axes of said arms, plunger link and connector link being substantially horizontal, said linkage being designed so that each said arm has a predetermined maximum arc of movement about its respective pivot points, said connecting links being arranged to extend between their pivotal mountings with a vertical component throughout movement of said arms through said predetermined arc of movement.

2. Positive displacement pump as claimed in claim 1 wherein said arm pivotal connections are coaxial and where the common axis approximately intersect with the longitudinal axis of the plunger.

3. Positive displacement pump as claimed in claim 1 wherein each arm remains above the end of the plunger link to which it is connected throughout said arc of movement.

4. Positive displacement pump as claimed in claim 2 wherein said arm pivotal connections are coaxial and where the common axis approximately intersect with the longitudinal axis of the plunger.

* * * * *